US008087971B2

(12) United States Patent
Asai

(10) Patent No.: US 8,087,971 B2
(45) Date of Patent: Jan. 3, 2012

(54) DOLL TOY

(75) Inventor: Masaki Asai, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 358 days.

(21) Appl. No.: 12/294,735

(22) PCT Filed: Feb. 26, 2007

(86) PCT No.: PCT/JP2007/053502

§ 371 (c)(1),
(2), (4) Date: Sep. 26, 2008

(87) PCT Pub. No.: WO2007/113949

PCT Pub. Date: Oct. 11, 2007

(65) Prior Publication Data

US 2010/0167624 A1 Jul. 1, 2010

(30) Foreign Application Priority Data

Mar. 30, 2006 (JP) ..... 2006-096087

(51) Int. Cl.
*A63H 3/46* (2006.01)

(52) U.S. Cl. ..... 446/376; 446/383; 446/390

(58) Field of Classification Search ..... 446/376, 446/377, 378, 379, 383, 384
See application file for complete search history.

(56) References Cited

U.S. PATENT DOCUMENTS

| | | | | |
|---|---|---|---|---|
| 1,324,057 | A * | 12/1919 | Malone | 446/376 |
| 2,752,726 | A | 7/1956 | Calverley | |
| 4,294,034 | A * | 10/1981 | Magria-Deulofeu et al. | 446/376 |
| 4,680,018 | A * | 7/1987 | Ohno | 446/376 |
| 6,110,002 | A | 8/2000 | Langton | |
| 6,267,640 | B1 * | 7/2001 | Akashi et al. | 446/376 |
| 6,419,546 | B1 | 7/2002 | Akashi et al. | |
| 7,331,841 | B2 * | 2/2008 | Okamoto et al. | 446/376 |
| 7,662,016 | B2 * | 2/2010 | Okamoto et al. | 446/376 |
| 2003/0162477 | A1 * | 8/2003 | Jheow | 446/376 |
| 2006/0189251 | A1 * | 8/2006 | Okamoto et al. | 446/376 |
| 2006/0258260 | A1 * | 11/2006 | Okamoto et al. | 446/321 |

FOREIGN PATENT DOCUMENTS

| | | |
|---|---|---|
| JP | 62-202897 | 12/1987 |
| JP | 11-076627 | 3/1999 |
| JP | 3087470 | 8/2002 |
| JP | 2005-034398 | 2/2005 |

OTHER PUBLICATIONS

Riichi Ito, "Motto Ugoku" Ganpura ga Tsukuritai! Model Graphix, vol. 21, No. 6, whole No. 235, Jun. 1, 2004, p. 30, Action 3.

* cited by examiner

*Primary Examiner* — Gene Kim
*Assistant Examiner* — Matthew B Stanczak
(74) *Attorney, Agent, or Firm* — Rankin, Hill & Clark LLP

(57) ABSTRACT

A doll toy is provided with a thigh section capable of turning further upward toward its chest section when extending ahead of its waist section. The doll toy includes a waist section, hip joint mechanisms, and thigh sections attached to a lower portion of the waist section via the hip joint mechanisms. The hip joint mechanisms include rotation links which rotate about a first rotation centerline within a predetermined rotation angular range, first connecting mechanisms which connect the rotation links to the waist section to allow the rotation links to rotate within the predetermined rotation angular range, stoppers disposed to restrict movement of the rotation links, and second connection mechanisms disposed to connect base portions of the thigh sections to the rotation links to allow the thigh sections to rotate about a second rotation centerline.

8 Claims, 12 Drawing Sheets

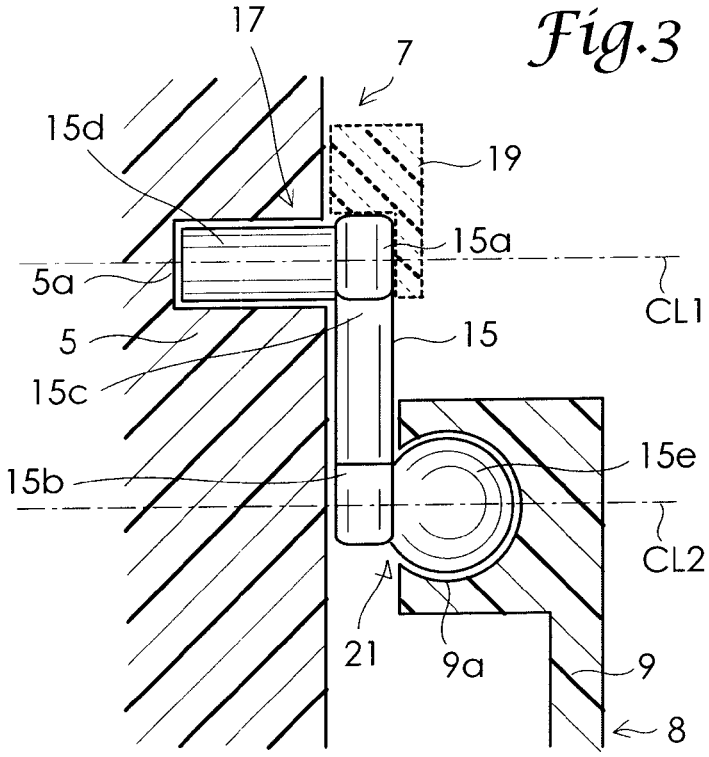
Fig.3
Fig.4
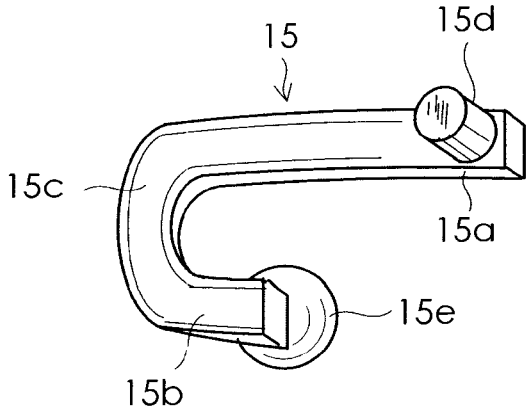

DOLL TOY

TECHNICAL FIELD

The present invention relates to a doll toy which includes a hip joint mechanism.

BACKGROUND ART

Japanese Patent Application Publication No. 2005-34398, (JP2005-34398A; Patent Document 1) discloses a hip joint mechanism of a doll toy in which a pair of thigh sections are connected to both sides of a crotch portion disposed in the center of a waist section, via a ball-shaped joint member. In this configuration, a depressed surface portion is formed in the upper end of the thigh section to be open toward the crotch portion, and ball-shaped join member is disposed in the depressed surface portion. A portion of the joint member, facing the crotch portion, is rotatably connected to a side portion of the crotch portion to rotate forward and backward. A portion of the joint member, facing the thigh section, is rotatably fitted into the depressed surface portion formed in the upper end of the thigh section. With such joint mechanism, the thigh section may be rotated forward about 90 degrees from the posture in which the thigh section and the waist section are located or extend upright in a top-to-bottom direction of the doll toy. Thus, the thigh sections may be rotated forward from the waist section at a right angle, and the doll toy may sit with the legs being stretched out. [Patent reference 1]

Japanese Patent Application Publication No. 2005-34398

SUMMARY OF INVENTION

Technical Problem

In the hip joint mechanism of the doll toy disclosed by JP2005-34398A, the front side of the thigh section abuts on the waist section when the upper end of the thigh section rotates with respect to the crotch joint portion of the waist section. Therefore, the thigh section cannot rotate any further. In this manner, a rotatable angular range of the thigh section with respect to the waist section is limited. Accordingly, though the thigh section of the doll toy cannot be rotated forward about 90 degrees with respect to the waist section when the thigh section and the waist section are located straight in the top-to-bottom direction, it is impossible to rotate the thigh section to largely turn more upward above the waist section. Accordingly, the above-mentioned hip joint mechanism cannot allow the doll toy to be transformed, for example, from a posture of standing upright into a posture of stretching the thigh sections ahead of the waist section, turning the thigh sections more upward above the waist section, and then sitting with the knees bent close to the chest or sitting holding the knees, namely, sitting in a special sitting style called "gymnastic sitting."

It is an object of the present invention to provide a doll toy of which the thigh section may be stretched out ahead of the waist section and may largely turn more upward above the waist section.

Another object of the present invention is to provide a doll toy which may sit with the knees bent close to the chest or sitting holding the knees.

A further object of the present invention is to provide a doll toy of which a hip joint mechanism is not transformed easily when the doll toy stands upright.

Solution of Problem

A doll toy of which the present invention aims at improvements includes a waist section, a hip joint mechanism, and a thigh section attached to a lower portion of the waist section via the hip joint mechanism. In the doll toy, the hip joint mechanism comprises a rotation link, a first connecting mechanism, a stopper, and a second connecting mechanism. The rotation link rotates about a first rotation centerline within a predetermined rotation angular range, the first rotation centerline extending in a direction orthogonal to a virtual plane which includes a virtual centerline extending in a top-to-bottom direction of the doll toy which stands upright and passing through the center of the waist section, and extends across the doll toy in a front-to-back direction of the doll toy. Here, the virtual centerline and the virtual plane are those hypothetically defined for convenience to definitely specify positions of the first rotation centerline and an after-mentioned second rotation centerline. The first rotation centerline is hypothetically defined for convenience to definitely specify the center of rotation about which the rotation link rotates with respect to the waist section.

The first connecting mechanism connects the rotation link to the waist section to allow the rotation link to rotate within a predetermined rotation angular range. The stopper is disposed in the waist section and restricts a movement of the rotation link so that the stopper may abut on the rotation link to prevent the rotation link from turning upward about the first rotation centerline when the thigh section extends in the top-to-bottom direction. The second connecting mechanism is disposed between the rotation link and the thigh section, and connects a base portion of the thigh section to the rotation link to allow the thigh section to rotate about a second rotation centerline when the rotation link abuts on the stopper. The second rotation centerline is located lower than the first rotation centerline and closer to a back side of the doll toy than the first rotation centerline is, and extends in parallel to the first rotation centerline. The second rotation centerline is hypothetically defined for convenience to definitely specify the center of rotation about which the thigh section rotates with respect to the rotation link.

In the doll toy of the present invention which includes such hip joint mechanism, the rotation link rotates about the first rotation centerline with respect to the waist section within the predetermined rotation angular range by means of the first connecting mechanism. The thigh section rotates about the second rotation centerline with respect to the rotation link by means of the second connecting mechanism. In this manner, the thigh section, which extends straight in the top-to-bottom direction with respect to the waist section, may rotate forward about 90 degrees. The thigh section may largely turn more upward (toward a chest section) within a large rotation angular range. The stopper restricts a movement of the rotation link so that the stopper may abut on the rotation link to prevent the rotation link from turning upward about the first rotation centerline when the thigh section extends in the top-to-bottom direction. That increases the stability of the hip joint mechanism constituting a connecting portion between the waist section and the thigh section, thereby preventing the hip joint mechanism from being transformed easily even when the doll toy stands upright.

Preferably, the waist section, the rotation link, and the thigh section are shaped so that the thigh section may turn more upward, rotating about the second rotation centerline at a predetermined angle after the rotation link rotates about the first rotation centerline at a maximum angle in a direction away from the stopper. With such configuration, since the thigh section may turn further about the second rotation centerline after the rotation link rotates about the first rotation centerline at the maximum angle, the rotation angular range of the thigh section becomes so large that the thigh section is turned close to the chest section.

As an example, the first connecting mechanism may include a lateral shaft secured onto the rotation link and having an axial line which coincides with the first rotation centerline, and a shaft receiving portion disposed in the waist section to rotatably support the lateral shaft. As another example, the first connecting mechanism may include a lateral shaft secured onto the waist section and having an axial line which coincides with the first rotation centerline, and a through hole formed in the rotation link, into which the lateral shaft is fitted to allow the rotation link to rotate about the lateral shaft within the predetermined angular range. As a further example, the first connecting mechanism may be a ball joint mechanism which includes a ball-shaped portion provided on an inside surface of the rotation link and a depressed portion formed in the waist section. The inside surface is opposed to the waist section. The first rotation centerline passes through the center of the ball-shaped portion. The depressed portion has a curved surface on an inner surface thereof, and the curved surface is curved along an outer surface of the ball-shaped portion. Thus, the ball-shaped portion is pivotally fitted into the depressed portion. As a yet further example, the first connecting mechanism may be a ball joint mechanism which includes a ball-shaped portion provided in the waist section and a depressed portion formed in the rotation link. The depressed portion has a curved surface on an inner surface thereof and the curved surface is curved along an outer surface of the ball-shaped portion. The depressed portion is disposed in a position on an inside surface of the rotation link, through which the first rotation centerline passes. Thus, the ball-shaped portion is pivotally fitted into the depressed portion. These examples of the first connecting mechanism as mentioned above make it possible to form a fitting structure between the waist section and the rotation link to allow the rotation link to rotate about the first rotation centerline with respect to the waist section. In particular, when the first connecting mechanism employs the ball joint mechanism, pivotal movement is available between the thigh section and the waist section. Therefore, an intricate rotational motion of the thigh section is available within a given rotation range of the ball joint mechanism. The first connecting mechanism is not limited to the above-mentioned four examples, and any other mechanism is available as far as it includes a fitting structure between the waist section and the rotation link to allow the rotation link to rotate with respect to the waist section.

Preferably, the rotation link includes a first end portion through which the first rotation centerline passes, a second end portion through which the second rotation centerline passes, and a connecting portion disposed between the first end portion and the second end portion. The connecting portion is configured to abut onto the stopper when the waist section and the thigh section are located in order in the top-to-bottom direction. Such configuration makes the rotation link to be fixedly held with respect to the waist section when the waist section and the thigh section are located in order in the top-to-bottom direction to prevent an occurrence of serious instability between the waist section and the thigh section even when the doll toy stands upright. The rotation link may be a plate-shaped link including a portion which abuts on the stopper. Such configuration may simplify the structures of the first/second end portions and the connecting portion, and the manufacturing of the rotation link will become easy.

For example, the second connecting mechanism may be a boll joint mechanism including a ball-shaped portion provided on an outside surface of the rotation link and a depressed portion formed in the base portion of the thigh section. The outside surface is located opposite to an inside surface of the rotation link and the inside surface is opposed to the waist section. The second rotation centerline passes through the center of the ball-shaped portion. The depressed portion has a curved surface on an inner surface thereof and the curved surface is curved along an outer surface of the ball-shaped portion. Thus, the ball-shaped portion is pivotally fitted into the depressed portion. As another example, the second connecting mechanism may be a boll joint mechanism including a ball-shaped portion provided in the base portion of the thigh section, and a depressed portion formed in the rotation link. The depressed portion has a curved surface on an inner surface thereof and the curved surface is curved along an outer surface of the ball-shaped portion. The depressed portion is disposed in a position on an outside surface of the rotation link, through which the second rotation centerline passes. The outside surface is located opposite to an inside surface of the rotation link, and the inside surface is opposed to the waist section. Thus, the ball-shaped portion is pivotally fitted into the depressed portion. When the second connecting mechanism is constituted from such ball joint mechanism, pivotal movement is available between the thigh section and the waist section. Therefore, an intricate rotational motion of the thigh section is available within a given rotation range of the ball joint mechanism. The second connecting mechanism is not limited to the above-mentioned two examples, and any other mechanism is available as far as it includes a fitting structure between the rotation link and the thigh section to allow the thigh section to rotate with respect to the rotation link.

BRIEF DESCRIPTION OF DRAWINGS

FIG. 3 is a schematic enlarged sectional view of one of the hip joint mechanisms.

FIG. 4 is a perspective view of a rotation link used in one of the hip joint mechanisms.

DESCRIPTION OF EMBODIMENTS

Figure 1A:
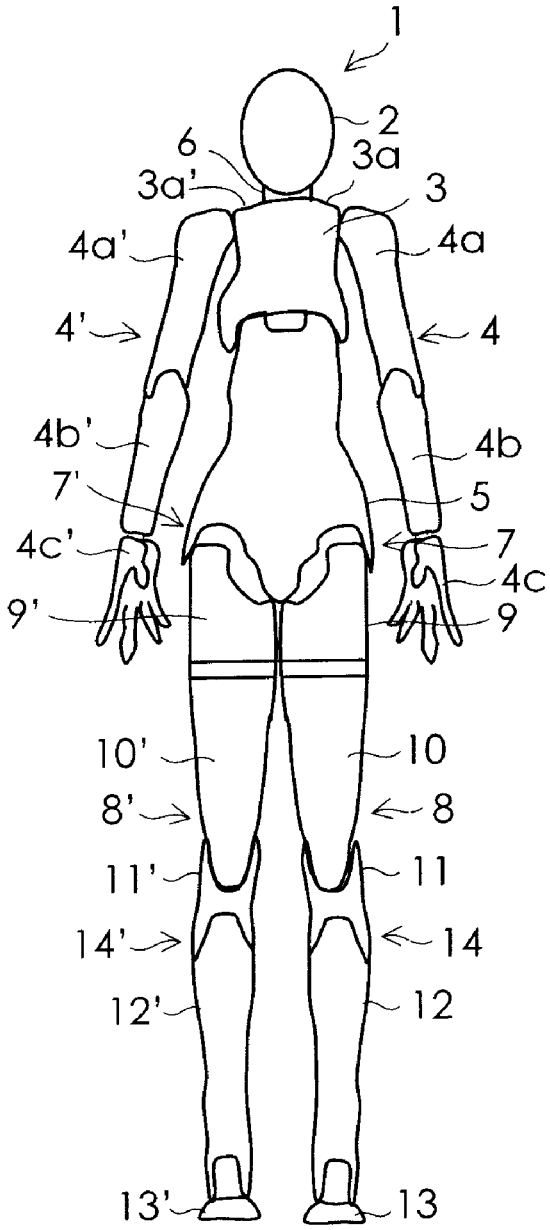
FIGS. 1A and 1B are a front view and a right side view when a doll toy of an embodiment of the present invention stands upright.
Figure 1B:
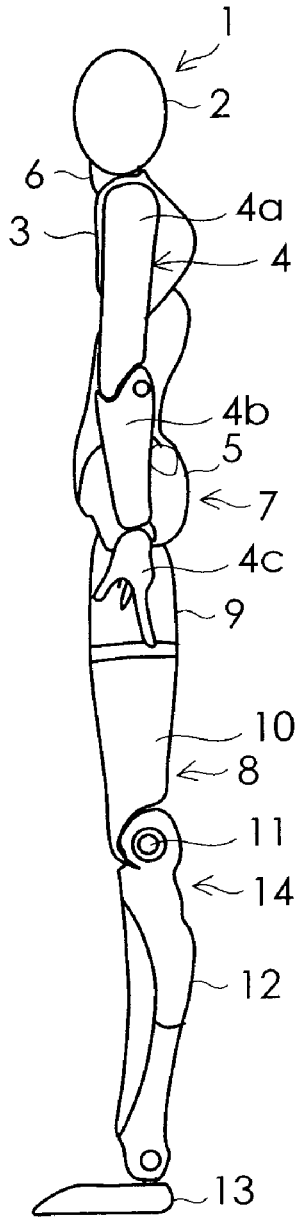

An embodiment of a doll toy according to the present invention will now be described hereinbelow with reference to the drawings. FIGS. 1A and 1B are a front view and a right side view when a doll toy 1 of an embodiment of the present invention stands upright. The doll toy 1 includes a head section 2, a chest section 3 disposed below the head section 2 via a neck section 6, and a waist section 5 disposed below the chest section 3. The chest section 3 and the waist section 5 constitute a body section of the doll toy 1. The chest section 3 includes a pair of shoulder sections 3*a* and 3*a*', and a pair of arm sections 4 and 4' are attached to the shoulder sections 3*a* and 3*a*' respectively. The pair of arm sections 4 and 4' are constituted from a pair of upper arm sections 4*a* and 4*a*', a pair of lower arm sections 4*b* and 4*b*', and a pair of hand sections 4*c* and 4*c*', respectively.

A pair of thigh sections 8 and 8', which form a part of leg sections 14 and 14' respectively, are attached to a lower portion of the waist section 5 via a pair of hip joint mechanisms 7 and 7', as described later. The hip joint mechanisms 7, 7' are omitted from FIG. 1. The thigh sections 8 and 8' include a pair of base portions 9 and 9' in the upper portions thereof and a pair of lower thigh sections 10 and 10' below the base portions 9 and 9' respectively. The base portions 9 and 9' and the lower thigh sections 10 and 10' are connected to each other to allow the lower thigh sections 10 and 10' to rotate with respect to the base portions 9 and 9' within a predetermined rotation angular range about a rotation axis, not shown, extending in a top-to-bottom direction of the doll toy. A pair of crus sections 12 and 12', which constitute apart of the leg sections 14 and 14', are attached to lower portions of the lower thigh sections 10 and 10' via a pair of knee joint mechanisms 11 and 11'. A pair of foot sections 13 and 13' are attached to the lower portions of the crus sections 12 and 12'. Except for the hip joint mechanisms 7 and 7', all joint mechanisms, which connect the above-mentioned component sections of the doll toy 1 denoted by reference numerals 2 to 13, are formed by a publicly known joint mechanism such as a rotating shaft mechanism or a ball joint mechanism. In the rotating shaft mechanism, a rotating shaft is disposed between components to allow the components to rotate about the rotating shaft with respect to each other. In the ball joint mechanism, a spherical portion or a ball-shaped portion is provided in one component and a depressed portion is formed in the other component so that the ball-shaped portion may pivotally be fitted into the depressed portion.

Figure 2A:
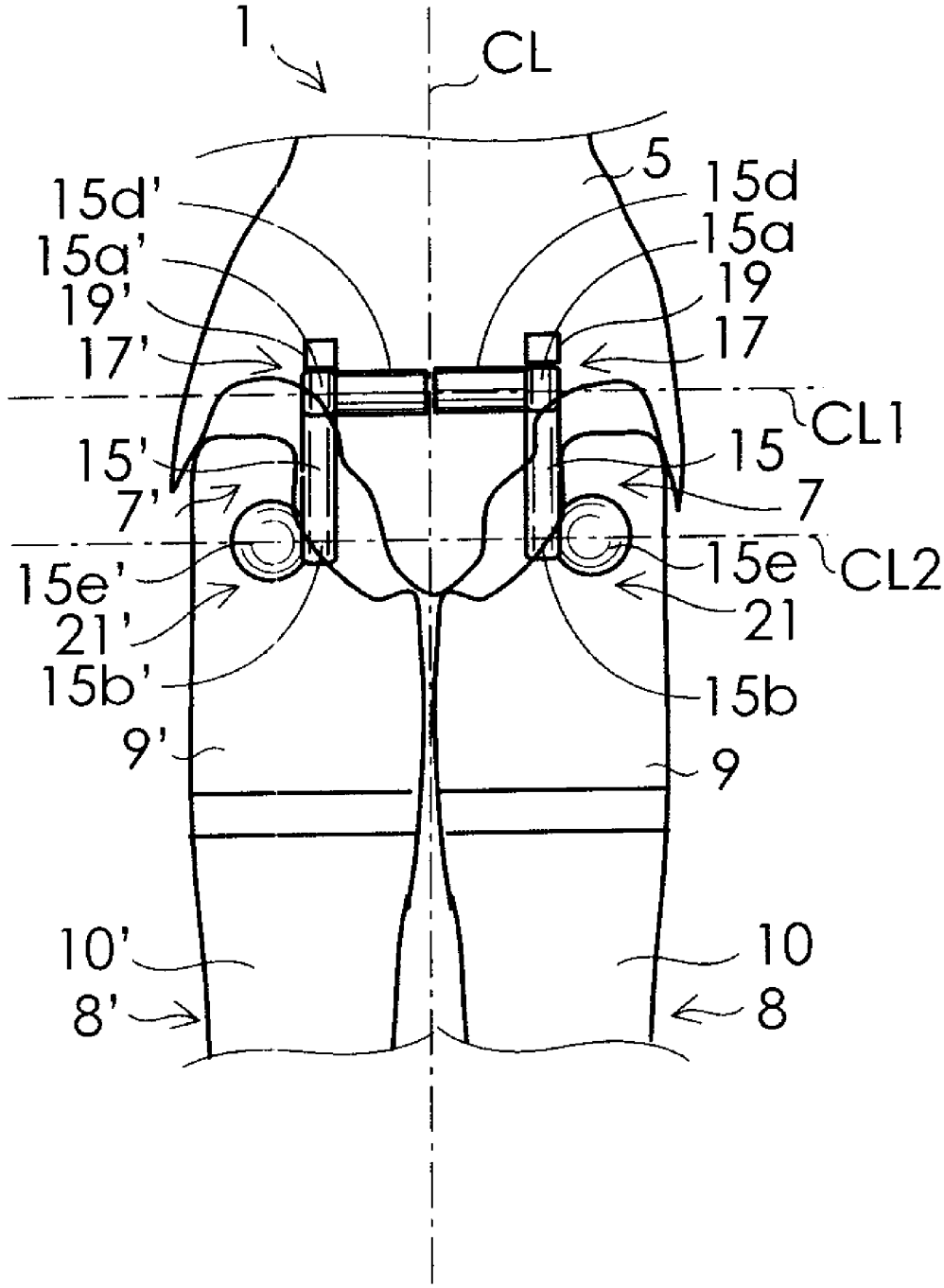
FIG. 2A is a partially enlarged view of FIG. 1A in which a waist section, a pair of hip joint mechanisms, and a pair of thigh sections are enlarged and shown as if they were all transparent components.
Figure 2B:
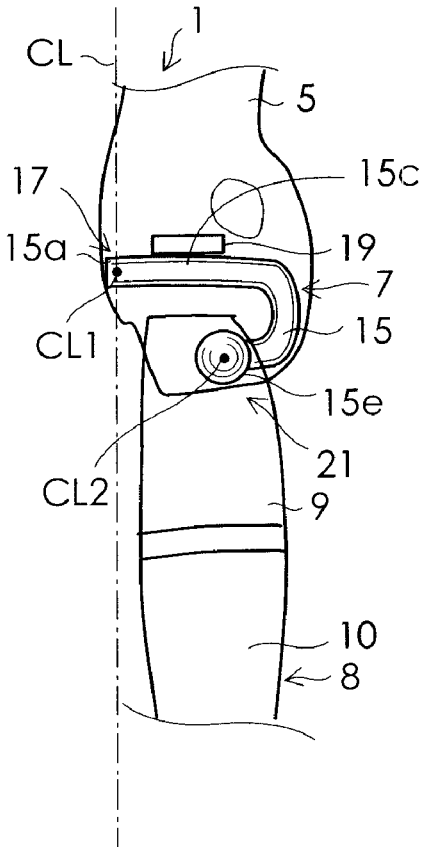
FIG. 2B is a right side view of FIG. 2A.
Figure 2C:
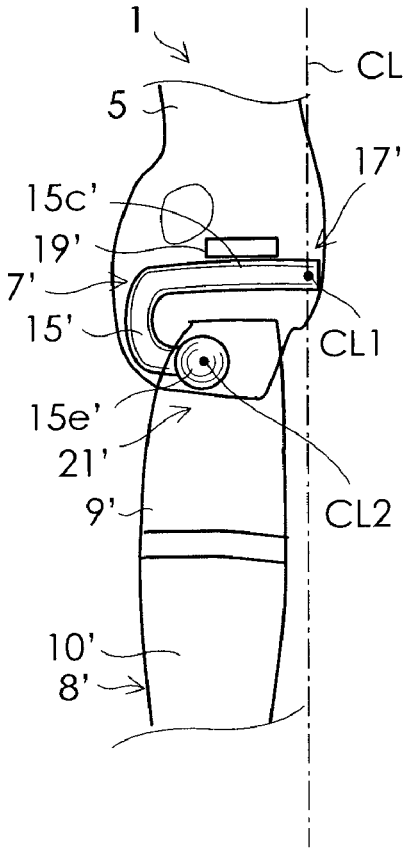
FIG. 2C is a left side view of FIG. 2A.

Next, an example of the hip joint mechanism used in an embodiment of the present invention will be described hereinbelow. FIG. 2A is a partially enlarged view of FIG. 1A in which the waist section, the hip joint mechanisms and the thigh sections are enlarged and shown as if they were all transparent components. FIG. 2B is a right side view of FIG. 2A, and FIG. 2C is a left side view of FIG. 2A. Since the hip joint mechanisms are symmetric in structure, FIG. 3 shows a schematic enlarged sectional view of one of the hip joint mechanisms, and FIG. 4 shows a perspective view of a rotation link used in one of the hip joint mechanisms. In FIG. 3, a cross section of the rotation link is not illustrated for easier understanding.

As shown in FIG. 2, the hip joint mechanisms 7 and 7' are constituted from rotation links 15 and 15', first connecting mechanisms 17 and 17', stoppers 19 and 19' and second connecting mechanisms 21 and 21' respectively. The rotation links 15 and 15' rotate forward and backward within a rotation angular range of about 90 degrees about a first rotation centerline CL1. Here, the first rotation centerline CL1 extends in a direction orthogonal to a virtual plane, not shown, which includes a virtual centerline CL extending in the top-to-bottom direction of the doll toy 1 which stands upright and passing through the center of the waist section 5 of the doll toy 1, and extends across the toy doll 1. The rotation link 15 and 15' include first end portions 15*a* and 15*a*' through which the rotation centerline CL1 passes, second end portions 15*b* and 15*b*' through which an after-mentioned second rotation centerline CL2 passes and connecting portions 15*c* and 15*c*' disposed between the first end portions 15*a* and 15*a*' and the second end portions 15*b* and 15*b*'. The rotation links 15 and 15' are shaped so that the connecting portions 15*c* and 15*c*' may abut onto stoppers 19 and 19' when the waist section 5 and the thigh sections 8 and 8' are located in order in the top-to-bottom direction, namely, when the doll toy stands upright. The stoppers 19 and 19' are disposed in lower portions of the waist section 5 on both sides thereof. The stoppers 19 and 19' will be described in detail later.

The rotation links 15 and 15' of the present embodiment each have a J-shaped configuration as viewed in an extending direction of the first rotation centerline CL1. Lateral shafts 15*d* and 15*d*', which constitute a part of the first connecting mechanisms 17 and 17' and each have an axial line which coincides with the first rotation centerline CL1. The lateral shafts 15*d* and 15*d*' are secured onto the first end portions 15*a* and 15*a*' of the rotation links 15 and 15'. The second end portions 15*b* and 15*b*' of the rotation links 15 and 15' include ball-shaped portions 15*e* and 15*e*' which constitute a part of the second connecting mechanism 21 respectively.

The first connecting mechanisms 17 and 17' connect the rotation links 15 and 15' to the waist section 5 to allow the rotation links 15 and 15' to rotate about the first rotation centerline CL1 within the rotation angular range of about 90 degrees with respect to the waist section 5. In this embodiment, as shown in FIG. 3, the first connecting mechanism 17 includes the lateral shaft 15*d* secured onto the rotation link 15 and having an axial line which coincides with the first rotation centerline CL1, and a shaft receiving portion 5*a* disposed in the waist section 5 to rotatably support the lateral shaft 15*d*. The other connecting mechanism 17' is configured in a similar manner. Although the illustration of the lateral shaft 15*d* and the shaft receiving portion 5*a* is simplified in this embodiment, they are actually configured in such a manner that once the lateral shaft 15*d* is fitted into the shaft receiving portion 5*a*, it hardly comes off the shaft receiving portion 5*a* and the lateral shaft 15*d* rotates about the first rotation centerline CL1. Specifically, an annular raised portion, not shown, is integrally formed on an outer peripheral surface of the lateral shaft 15*d* in a circumferential direction thereof, and an annular groove portion, not shown, is formed in an inner peripheral surface of the shaft receiving portion 5*a* to be fitted with the raised portion. The lateral shaft 15*d* is inserted into the shaft receiving portion 5*a* by compressing and deforming the annular raised portion formed on the lateral shaft 15*d*, and the annular raised portion comes to be fitted into the groove portion. Such configuration makes it possible to prevent the lateral shaft 15*d* from easily coming off the shaft receiving portion 5*a*. The lateral shaft 15*d* may extend across or protrude from both sides of the rotation link 15 in the thickness direction thereof so that the both ends of the lateral shaft 15*d* may be rotatably supported.

The stoppers 19 and 19' are disposed in the waist section 5 to restrict a movement of the rotation links 15 and 15' so that the stoppers 19 and 19' may abut on the rotation links 15 and 15' to prevent the rotation links 15 and 15' from turning upward about the first rotation centerline CL1 when the waist section 5 and the thigh sections 8 and 8' are located in the top-to-bottom direction of the doll toy 1. The stoppers 19 and 19' may be constituted from a part of the waist section 5, or may be constituted from a component separate from the waist section 5. In this embodiment, the stoppers 19 and 19' are constituted separately from the waist section 5.

The second connecting mechanisms 21 and 21' are disposed between the rotation links 15 and 15' and the base portions 9 and 9' of the thigh sections 8 and 8'. The second connecting mechanisms 21 and 21' connect the base portions 9 and 9' of the thigh sections 8 and 8' to the rotation links 15 and 15' to allow the thigh sections 8 and 8' to rotate about a second rotation centerline CL2 which is located lower than the first rotation centerline CL1 and closer to a back side of the doll toy 1 than the first rotation centerline CL1 is, and extends in parallel to the first rotation centerline CL1 when the rotation links 15 and 15' abut on the stoppers 19 and 19'. In the present embodiment, as shown in FIG. 3, the second connecting mechanism 21 is a boll joint mechanism including a ball-shaped portion 15*e* provided in the rotation link 15 and a depressed portion 9*a* formed in the base portion 9 of the thigh sections 8. Here, the ball-shaped portion 15*e* is disposed on an outside surface of the rotation link 15. The outside surface is located opposite to an inside surface of the rotation link 15 and the inside surface faces or is opposed to the waist section 5. The second rotation centerline CL2 passes through the center of the ball-shaped portion 15*e*. The depressed portion 9*a* has a curved surface on an inner surface thereof and the curved surface is curved along an outer surface of the ball-shaped portion 15*e*, and is formed in the base position 9. Thus, the ball-shaped portion 15*e* is pivotally fitted into the depressed portion 9*a*. When the second connecting mechanisms 21 and 21' employ such a ball joint mechanism, a pivotal movement is available between the thigh sections 8 and 8' and the waist section 5, thereby enabling an intricate rotational motion of the thigh sections 8 and 8' within a given rotation range of the ball joint mechanism. As a result, it becomes possible for the thigh sections 8 and 8' to rotate not only forward and backward but also in the right and left direction.

Figure 5:
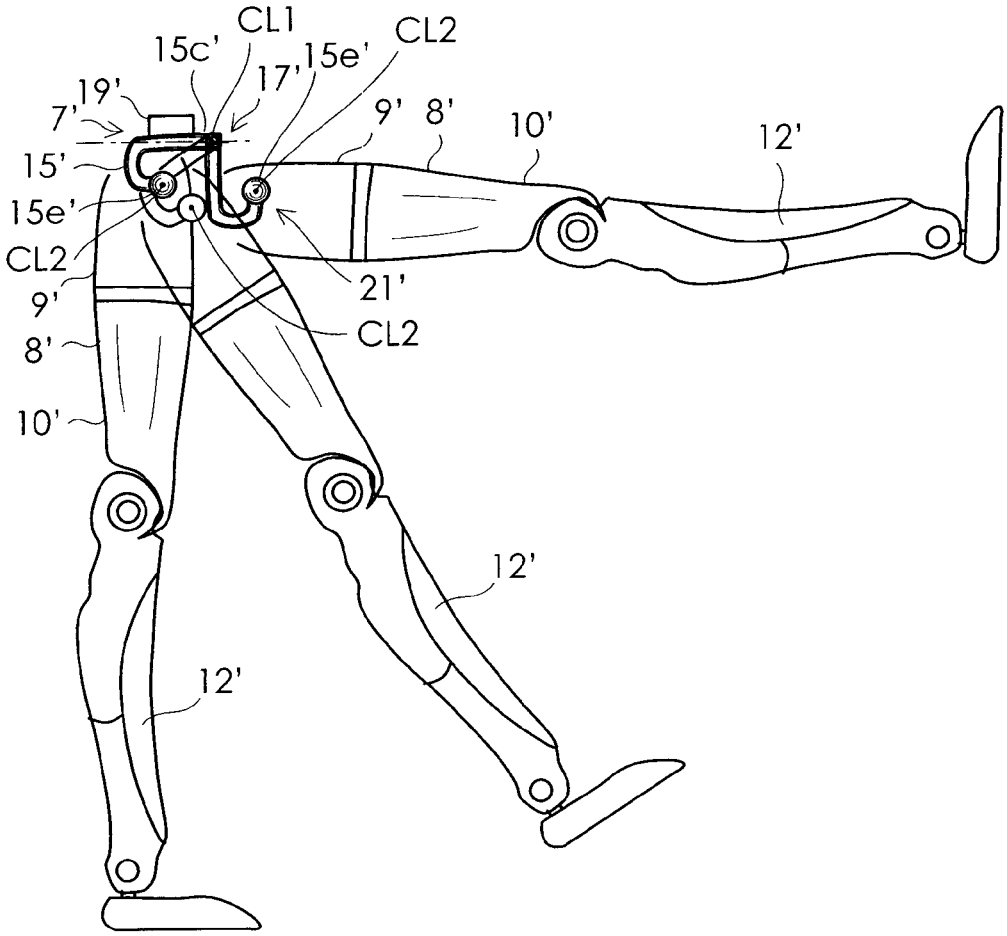
FIG. 5 shows a rotation process of the rotation link and a change in posture of the doll toy when the doll toy is being transformed.
Figure 6A:
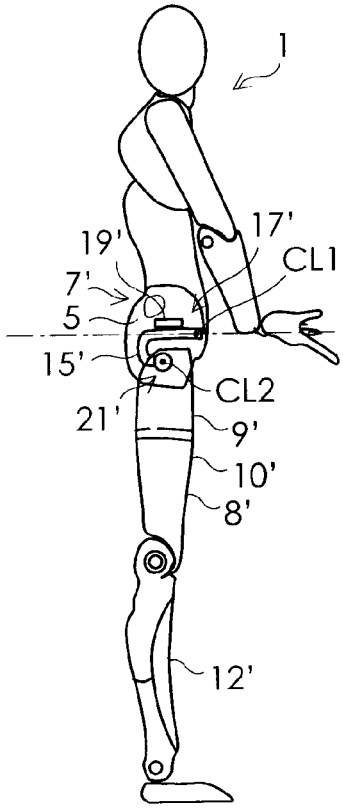
FIGS. 6A to 6D show a rotation process of the rotation link and a change in posture of the doll toy when the doll toy is being transformed.
Figure 6B:
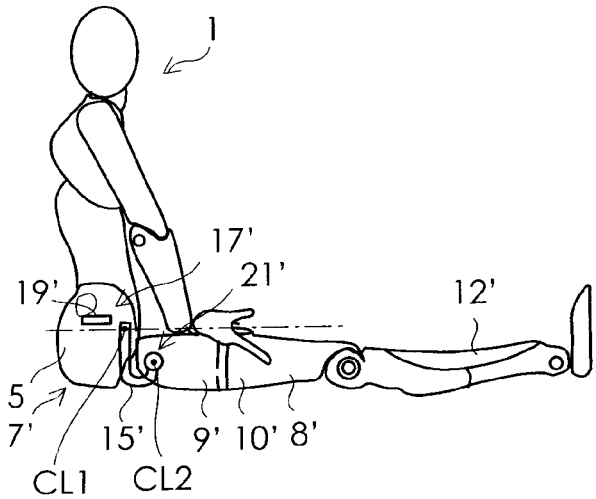

To transform the doll toy of the present embodiment, which has the above-mentioned hip joint mechanisms 7 and 7', into a posture of sitting with the knees bent close to the chest or sitting holding the knees or sitting in a so-called gymnastic sitting style, the respective component sections of the doll toy are displaced as follows. FIGS. 5 and 6 show a rotation process of the rotation links 15 and 15' when the doll toy is being transformed. FIG. 7 shows a change in posture of the doll toy 1 when it is being transformed. First, as shown in FIGS. 5, 6A and 6B, the rotation links 15 and 15' rotate about the rotation centerline CL1 with respect to the waist section 5 within the rotation angular range of about 90 degrees by means of the first connecting mechanisms 17 and 17'. At that time, the ball-shaped portions 15*e* and 15*e*' provided in the rotation links 15 and 15' have been displaced to a position which is lower than the rotation centerline CL1 and more forward than before (refer to FIG. 6B). Namely, the ball-shaped portions 15*e* and 15*e*' are located ahead of the waist section 5 and away from the waist section 5. In such position, the waist section 5 hardly impedes a motion of the thigh sections 8 and 8'.

Figure 6C:
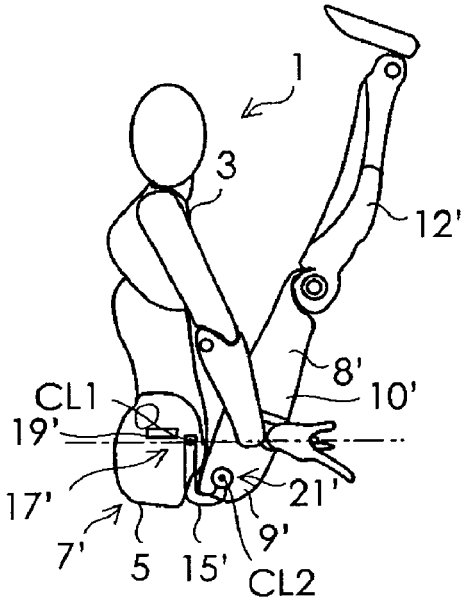
Figure 6D:
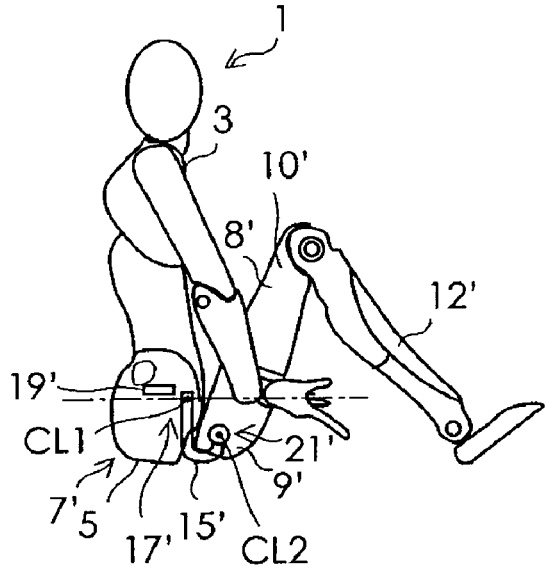
Figure 7A:
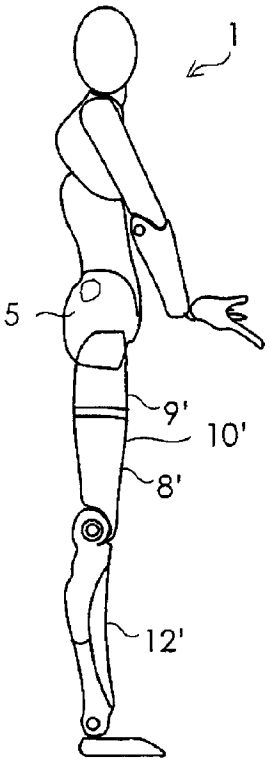
FIGS. 7A to 7C show a change in appearance of the doll toy when the doll toy is being transformed.
Figure 7B:
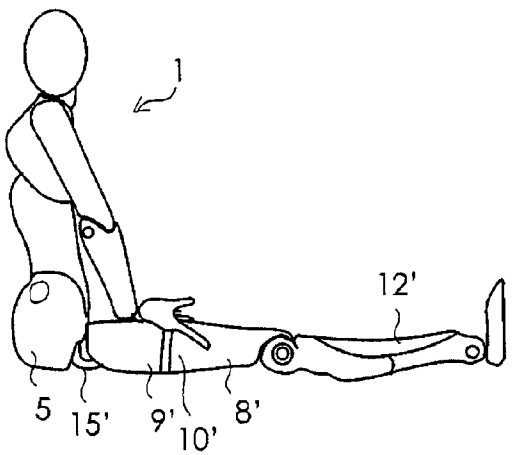
Figure 7C:
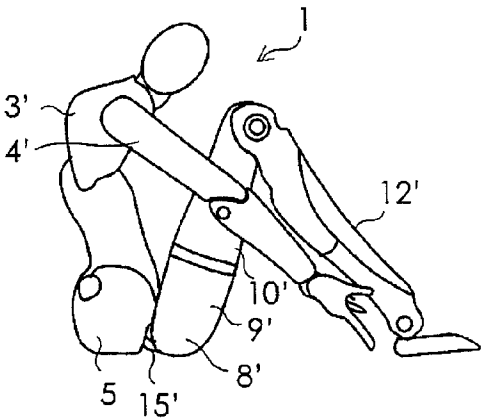

Next, as shown in FIG. 6C, the thigh sections 8 and 8' rotates upward about the second rotation centerline CL2 with respect to the rotation links 15 and 15' by means of the second connecting mechanisms 21 and 21'. Then, as shown in FIG. 6D, the crus sections 12 and 12' turn downward with respect to the thigh sections 8 and 8'. Alternatively, the crus sections 12 and 12' may be turned downward with respect to the thigh sections 8 and 8' before turning the thigh sections 8 and 8' with respect to the rotation links 15 and 15'. According to the present embodiment, the thigh sections 8 and 8', which extend straight with respect to the waist section 5 in the top-to-bottom direction of the doll toy as shown in FIG. 6A, may turn forward about 90 degrees to locate the thigh sections 8 and 8' ahead of the waist section 5, as shown in FIG. 6B. Then, the thigh sections 8 and 8' may turn more upward to approach the chest section 3 within a large rotation angular range as shown in FIG. 6C. As a result, as shown in FIG. 7, it becomes possible for the doll toy 1 of the present embodiment to be transformed into a posture of sitting with the knees bent close to the chest or sitting holding the knees or sitting in a so-called gymnastic sitting style.

In particular, according to the present embodiment, the stoppers 19 and 19' abut on the rotation links 15 and 15' when the doll toy 1 stands upright, and the thigh sections 8 and 8' extend in the top-to-bottom direction of the doll toy. The stoppers 19 and 19' restrict a movement of the rotation links 15 and 15' so that the stopper may abut on the rotation links 15 and 15' to prevent the rotation links 15 and 15' from turning upward about the first rotation centerline CL1 (in FIG. 5, the rotation links is prevented from rotating clockwise). As a result, the stability of the hip joint mechanisms 7 and 7' constituting a connecting portion between the waist section 5 and the thigh sections 8 and 8' increases, thereby preventing the hip joint mechanism from being transformed easily even when the doll toy 1 stands upright.

In this embodiment, the waist section 5, the rotation links 15 and 15', and the thigh sections 8 and 8' are shaped so that the thigh sections 8 and 8' may turn more upward, rotating about the second rotation centerline CL2 about 90 degrees after the rotation links 15 and 15' rotate on the first rotation centerline CL1 about 90 degrees in a direction away from the stoppers 19 and 19'. In this manner, since the thigh sections 8 and 8' turn more upward about the second rotation centerline CL2 after the rotation links 15 and 15' rotate about the first rotation centerline CL1 at a maximum angle, the rotation angular range of the thigh sections 8 and 8' becomes so large that the thigh sections 8 and 8' are turned close to the chest section 3.

Figure 8A:
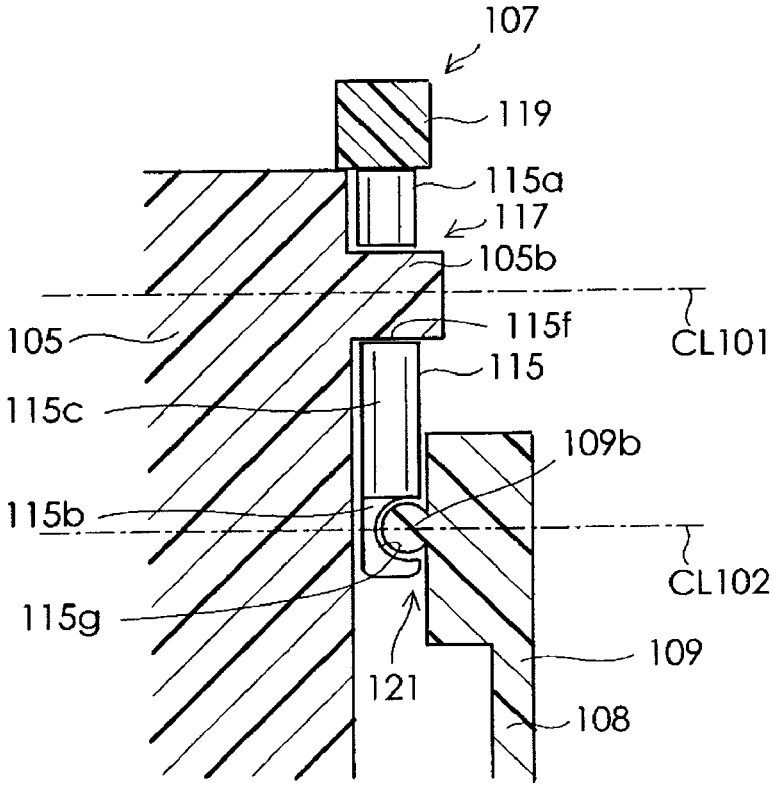
FIGS. 8A and 8B explain another example of the hip joint mechanism.
Figure 8B:
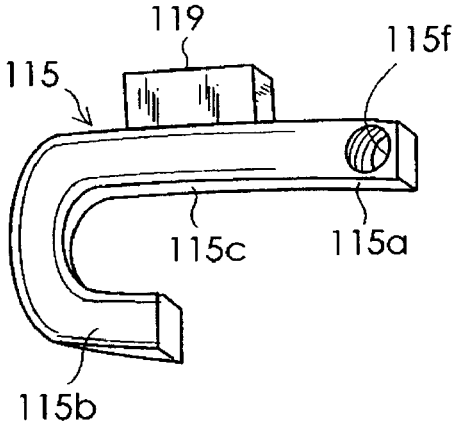

Next, modifications of the hip joint mechanism applicable to the present invention will be explained. In a hip joint mechanism shown in FIGS. 8A and 8B, portions similar to those of the corresponding hip joint mechanism 7 of the above-mentioned embodiment shown in FIGS. 1 to 4 have their reference numerals calculated by adding a number 100 to the corresponding reference numerals shown in FIGS. 1 to 4, and their descriptions will be omitted. In the hip joint mechanism 107 shown in FIG. 8, a first connecting mechanism 117 includes a lateral shaft 105*b* secured onto a waist section 105 and having an axial line which coincides with a first rotation centerline CL101, and a through hole 115*f* formed in a rotation link 115 into which the lateral shaft 105*b* is fitted to allow the rotation link 115 to rotate about the lateral shaft 105*b* within a rotation angular range of about 90 degrees. A second connecting mechanism 121 is a boll joint mechanism including a ball-shaped portion 109*b* provided in a base portion 109 of a thigh section 108, and a depressed portion 115*g* formed in an outside surface of the rotation link 115. The outside surface is located opposite to an inside surface of the rotation link 115 and the inside surface is opposed to or faces the waist section 105. The depressed portion 115*g* has a curved surface on an inner surface thereof and the curved surface is curved along an outer surface of the ball-shaped portion 109*b*. The depressed portion is disposed in a position, through which a second rotation centerline CL102 passes. Thus, the ball-shaped portion 109*b* is pivotally fitted into the depressed portion 115*g*.

Figure 9A:
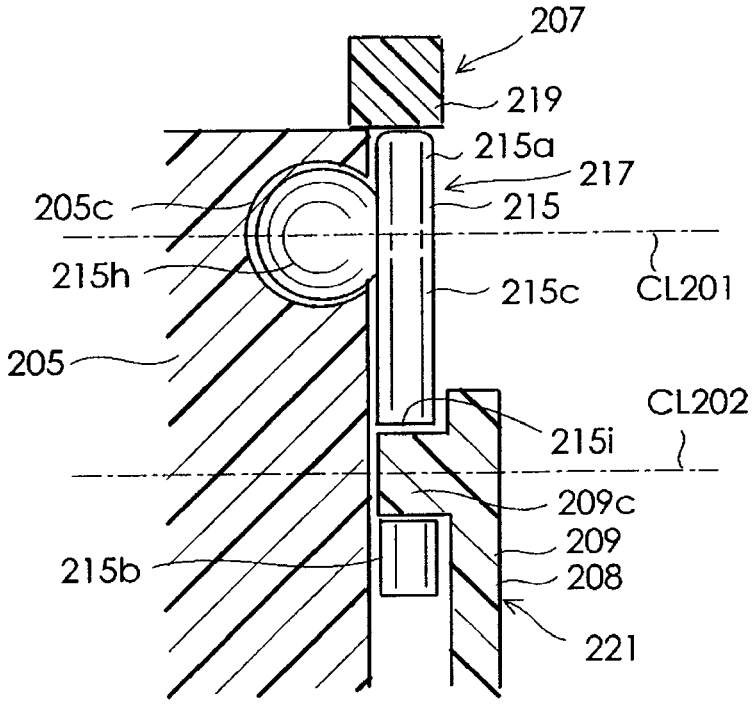
FIGS. 9A and 9B explain another example of the hip joint mechanism.
Figure 9B:
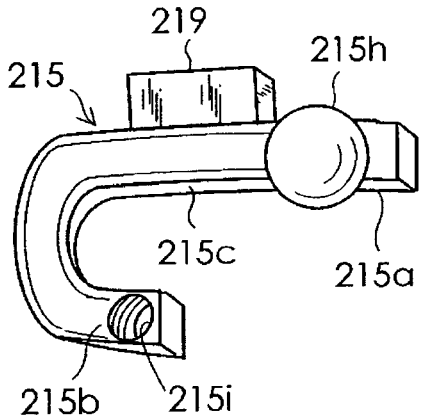

In a hip joint mechanism shown in FIGS. 9A and 9B, portions similar to those of the corresponding hip joint mechanism 7 of the above-mentioned embodiment shown in FIGS. 1 to 4 have their reference numerals calculated by adding a number 200 to the corresponding reference numerals shown in the embodiment of FIGS. 1 to 4, and their descriptions will be omitted. In the hip joint mechanism 207 shown in FIGS. 9A and 9B, a first connecting mechanism 217 is a ball joint mechanism including a ball-shaped portion 215*h* provided in a rotation link 215 and a depressed portion 205*c* formed in a waist section 205. The ball-shaped portion 215*h* is provided on an inside surface of the rotation link 215, and the inside surface is opposed to or faces the waist section 205. A first rotation centerline CL201 passes through the center of the ball-shaped portion 215*h*. The depressed portion 205*c* has a curved surface on an inner surface thereof, and the curved surface is curved along an outer surface of the ball-shaped portion 215*h*. Thus, the ball-shaped portion 215*h* is pivotally fitted into the depressed portion 205*c*. A second connecting mechanism 221 includes a lateral shaft 209*c* secured onto a base portion 209 of a thigh section 208 and has an axial line which coincides with a second rotation centerline CL202, and a through hole 215*i* formed in the rotation link 215, into which the lateral shaft 209*c* is fitted to allow the rotation link 215 to rotate about the lateral shaft 209*c* within a predetermined rotation angular range of about 90 degrees.

Figure 10A:
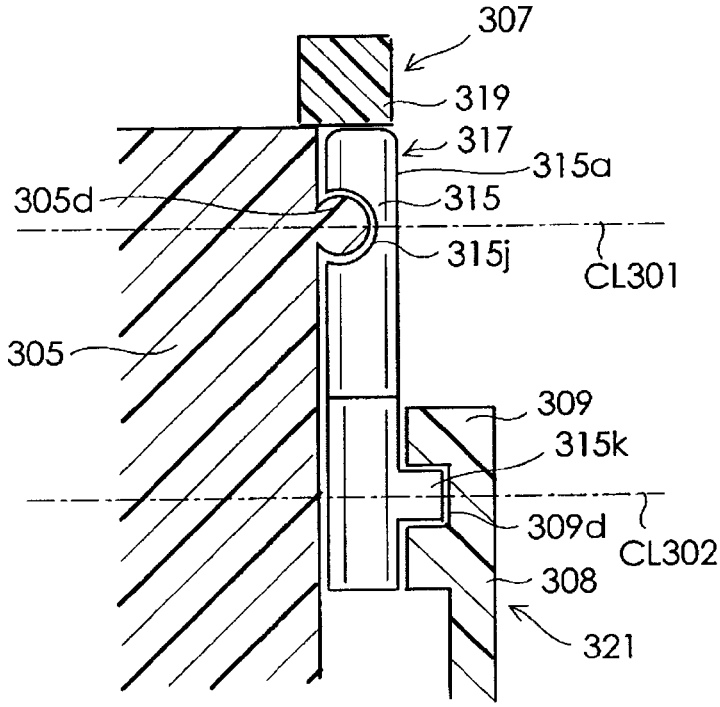
FIGS. 10A and 10B explain another example of the hip joint mechanism.
Figure 10B:
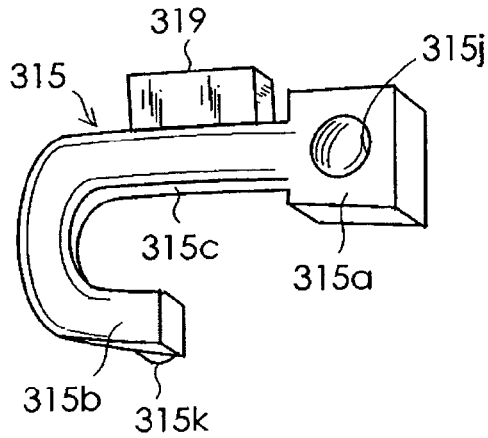
Figure 11A:
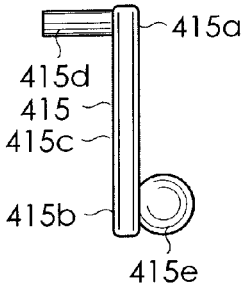
FIGS. 11A to 11C show another example configuration of the rotation link.
Figure 11B:
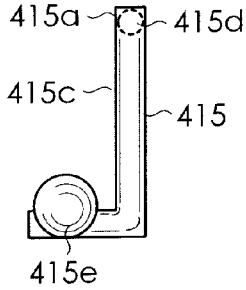
Figure 11C:
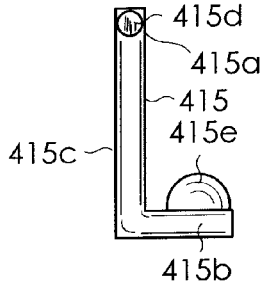

In a hip joint mechanism shown in FIGS. 10A and 10B, portions similar to those of the corresponding hip joint mechanism 7 shown in FIGS. 1 to 4 have their reference numerals calculated by adding a number 300 to the corresponding reference numerals shown in FIGS. 1 to 4, and their descriptions will be omitted. In the hip joint mechanism 307 shown in FIGS. 10A and 10B, a first connecting mechanism 317 is a ball joint mechanism including a ball-shaped portion 305*d* provided in a waist section 305 and a depressed portion 315*j* formed in an inside surface of the rotation link. The inside surface is opposed to or faces a waist section 305. The depressed portion 315*j* has a curved surface on an inner surface thereof and the curved surface is curved along an outer surface of the ball-shaped portion 305*d*. The depressed portion 315*j* is disposed in a position through which a first rotation centerline CL301 passes. Thus, the ball-shaped portion 305*d* is pivotally fitted into the depressed portion 315*j*. A second connecting mechanism 321 includes a lateral shaft 315*k* secured onto the rotation link 315 and having an axial line which coincides with a second rotation centerline CL302, and a shaft receiving portion 309*d* formed in a base portion 309 of a thigh section 308 to rotatably support the lateral shaft 315*k*. When the first connecting mechanism employs such a ball joint mechanism as shown in FIGS. 9 and 10, a pivotal movement is available between the thigh section and the waist section, thereby enabling an intricate rotational motion of the thigh section within a given rotation range of the ball joint mechanism.

Any other modification may be applied to the first connecting mechanism besides those shown in FIGS. 8 to 10. Namely, the configuration of the first connecting mechanism is arbitrary as far as it includes a fitting structure between the waist section and the rotation link to allow the rotation link to rotate with respect to the waist section. Similarly, the configuration of the second connecting mechanism is arbitrary as far as it includes a fitting structure between the rotation link and the base portion of the thigh section to allow the base portion of the thigh section to rotate with respect to the rotation link.

Figure 12A:
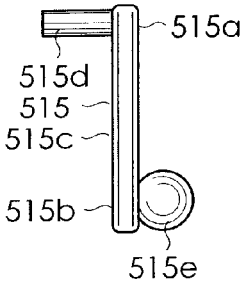
FIGS. 12A to 12C show another example configuration of the rotation link.
Figure 12B:
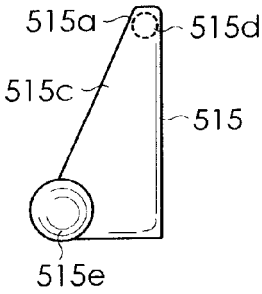
Figure 12C:
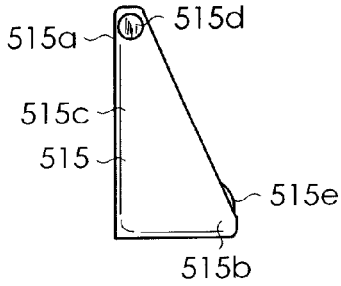

Next, another example configuration of the rotation link used in the hip joint mechanism of an embodiment of the present invention will be described hereinbelow. FIGS. 11A to 11C and FIGS. 12A to 12C show examples of the rotation link. Portions functionally similar to those of the corresponding rotation link 15 of FIGS. 3 and 4 have their reference numerals calculated by adding a number 400 or 500 to the corresponding reference numerals shown in FIGS. 3 and 4 respectively, and their descriptions will be omitted. In the rotation link shown in FIGS. 3 and 4, an abbreviated J-letter shape is formed from the first end portion 15*a* through which the first rotation centerline CL1 passes to the second end portion 15*b* through which the second rotation centerline CL2 passes. In the rotation link 415 of FIG. 11, an L-letter shape is formed for a connecting portion 415*c* of a rotation link 415, which extends from a first end portion 415*a* to a second end portion 415*b*. A rotation link 515 shown in FIG. 12 is shaped in a trapezoidal plate. Such rotation links as mentioned above also have the same function as the rotation link 15 of FIGS. 3 and 4.

If the rotation link is shaped in an abbreviated J-letter or L-letter, the bent portion of the J-letter shape or the right angular portion of the L-shape may be weak in mechanical strength due to its structure. Compared with these shapes, the plate-shaped rotation link as shown in FIG. 12 is not readily be broken when a strong shock is externally applied since it does not have a fragile portion such as a bent portion of the J-letter shape or a right angular portion of the L-letter shape.

INDUSTRIAL APPLICABILITY

In the doll toy of the present invention, the rotation link rotates about the first rotation centerline with respect to the waist section within a predetermined rotation angular range by means of the first connecting mechanism. Then, the thigh section rotates about the second rotation centerline with respect to the rotation link by means of the second connecting mechanism. In this manner, the thigh section, which extends straight in the top-to-bottom direction of the doll toy with respect to the waist section, may turn forward about 90 degrees to locate the thigh section ahead of the waist section. Then, the thigh section may turn more upward above the waist section within a large rotation angular range. As a result, the doll toy of the present invention may sit with the knees bent close to the chest or sit holding the knees. The stopper restricts a movement of the rotation link so that the stopper may abut on the rotation link to prevent the rotation link from turning upward about the first rotation centerline when the thigh section extends in the top-to-bottom direction of the doll toy which stands. That increases the stability of the hip joint mechanism constituting a connecting portion between the waist section and the thigh section, thereby preventing the hip joint mechanism from being transformed easily even when the doll toy stands upright.

The invention claimed is:

1. A doll toy including a waist section, a hip joint mechanism, and a thigh section directly attached to a lower portion of the waist section via the hip joint mechanism, the hip joint mechanism comprising:

a rotation link which rotates about a first rotation centerline within a predetermined rotation angular range, the first rotation centerline extending in a direction orthogonal to a virtual plane which includes a virtual centerline extending in a top-to-bottom direction of the doll toy which freely stands and passing through the center of the waist section, the virtual plane extending across the doll toy in a front-to-back direction of the doll toy;

a first connecting mechanism which connects the rotation link to the waist section to allow the rotation link to rotate within the predetermined rotation angular range;

a stopper disposed in the waist section and restricting a movement of the rotation link so that the stopper may abut on the rotation link to prevent the rotation link from rotating upward about the first rotation centerline when the thigh section extends in the top-to-bottom direction; and a second connecting mechanism disposed between the rotation link and the thigh section, and connecting a base portion of the thigh section to the rotation link to allow the thigh section to rotate about a second rotation centerline when the rotation link abuts on the stopper, the second rotation centerline being located lower than the first rotation centerline and closer to a back side of the doll toy than the first rotation centerline is, and extending in parallel to the first rotation centerline, wherein the waist section, the rotation link, and the thigh section are shaped such that after the rotation link has rotated about the first rotation centerline at a maximum angle in a direction away from the stopper, the second rotation centerline is located in front of the waist section, and that the thigh section is able to rotate more upward, rotating about the second rotation centerline at a predetermined angle, and wherein the rotation link comprises a first end portion through which the first rotation centerline passes, a second end portion through which the second rotation centerline passes, and a connecting portion disposed between the first end portion and the second end portion; and the connecting portion abuts onto the stopper when the waist section and the thigh section are located in order in the top-to-bottom direction.

2. The doll toy of claim 1, wherein the first connecting mechanism includes a lateral shaft secured onto the rotation link and having an axial line which coincides with the first rotation centerline, and a shaft receiving portion disposed in the waist section to rotatably support the lateral shaft.

3. The doll toy of claim 1, wherein the first connecting mechanism includes a lateral shaft secured onto the waist section and having an axial line which coincides with the first rotation centerline, and a through hole, formed in the rotation link, into which the lateral shaft is fitted to allow the rotation link to rotate about the lateral shaft within the predetermined angular range.

4. The doll toy of claim 1, wherein the first connecting mechanism is a ball joint mechanism including a ball-shaped portion provided on an inside surface of the rotation link and a depressed portion formed in the waist section, the inside surface being opposed to the waist section; the first rotation centerline passes through the center of the ball-shaped portion; the depressed portion has a curved surface on an inner surface thereof, the curved surface being curved along an outer surface of the ball-shaped portion; and the ball-shaped portion is pivotally fitted into the depressed portion.

5. The doll toy of claim 1, wherein the first connecting mechanism is a ball-joint mechanism including a ball-shaped portion provided in the waist section and a depressed portion formed in the rotation link; the depressed portion has a curved surface on an inner surface thereof, the curved surface being curved along an outer surface of the ball-shaped portion, and the depressed portion is disposed in a position on an inside surface of the rotation link, through which the first rotation centerline passes, the inside surface being opposed to the waist section; and the ball-shaped portion is pivotally fitted into the depressed portion.

6. The doll toy of claim 1, wherein the rotation link is a plate-shaped link including a portion which abuts on the stopper.

7. The doll toy of claim 1, wherein the second connecting mechanism is a ball joint mechanism including a ball-shaped portion provided on an outside surface of the rotation link, and a depressed portion formed in the base portion of the thigh section, the outside surface being located opposite to an inside surface of the rotation link, the inside surface being opposed to the waist section; the second rotation centerline passes through the center of the ball-shaped portion; the depressed portion has a curved surface on an inner surface thereof, the inner surface being curved along an outer surface of the ball-shaped portion; and the ball-shaped portion is pivotally fitted into the depressed portion.

8. The doll toy of claim 1, wherein the second connecting mechanism is a ball joint mechanism including a ball-shaped portion provided in the base portion of the thigh section, and a depressed portion formed in the rotation link; the depressed portion has a curved surface on an inner surface thereof, the inner surface being curved along an outer surface of the ball-shaped portion; the depressed portion is disposed in a position on an outside surface of the rotation link, through which the second rotation centerline passes, the outside surface being located opposite to an inside surface of the rotation link, the inside surface being opposed to the waist section; and the ball-shaped portion is pivotally fitted into the depressed portion.

* * * * *